United States Patent [19]

Toth

[11] Patent Number: 4,508,118

[45] Date of Patent: Apr. 2, 1985

[54] DIAPHRAGM ASSEMBLY FOR SCUBA DIVING REGULATOR

[75] Inventor: Douglas J. Toth, Long Beach, Calif.

[73] Assignee: Under Sea Industries, Inc., Rancho Dominguez, Calif.

[21] Appl. No.: 491,373

[22] Filed: May 4, 1983

[51] Int. Cl.[3] ..... A62B 7/04

[52] U.S. Cl. ..... 128/204.26; 137/494; 92/101

[58] Field of Search ..... 128/204.26, 204.27; 137/494; 92/101, 129

[56] References Cited

U.S. PATENT DOCUMENTS 2,758,596 8/1956 Cupp ..... 128/204.26
4,386,624 6/1983 Christianson ..... 128/204.26

FOREIGN PATENT DOCUMENTS 207994 5/1957 Australia ..... 128/204.26
2406307 8/1975 Fed. Rep. of Germany ..... 128/204.26
1340197 9/1963 France ..... 128/204.26

*Primary Examiner*—Henry J. Recla
*Attorney, Agent, or Firm*—Flam & Flam

[57] ABSTRACT

A diaphragm for a scuba diving regulator incorporates a contact member in the form of an axially thin spool cast or fabricated of low friction material. The contact member is installed at a central aperture of the diaphragm so that the end plates or flanges of the spool closely encompass the diaphragm on opposite sides. One of the flanges is located on the outside of the diaphragm, and the other is located on the inside, to be engaged by the actuating lever of the demand valve. No special sealing means need be provided about the spool, since the pressure difference between the ambient water and the air in the breathing chamber is always small, whatever be the depth of the diver in the water, but effective to maintain the seal.

1 Claim, 4 Drawing Figures

DIAPHRAGM ASSEMBLY FOR SCUBA DIVING REGULATOR

FIELD OF INVENTION

This invention relates to component parts of a scuba diving regulator and, more particularly, to a diaphragm and contact plate assembly therefor.

BACKGROUND OF INVENTION

Almost universally, a thin elastomeric diaphragm is used to close an opening in a regulator case so that the pressure of air in a breathing chamber is equalized to that of the ambient water. As the diver withdraws air from the breathing chamber, the air pressure in the breathing chamber reduces, causing inward movement of the diaphragm. An actuator is thereby caused to move and to open a demand valve. Air pressure is restored. Under equilibrium conditions, the pressure in the chamber, supplemented by a small biasing force such as by a return spring, equals the pressure of the water, whatever the water pressure may be. By equalizing the pressure of supplied air to that of the surrounding water, the diver's breathing effort is minimized.

Certain patent and other literature stresses the desirability of locating the control diaphragm at the level of the center of pressure of the diver's lungs. The literature also emphasizes the desirability of sensitivity and low friction characteristics of the demand valve itself in order that the biasing force can be minimized, thereby to achieve very close equality between breathing chamber pressure and ambient water pressure.

In order to minimize friction, one prior art device uses a polished metal plate partially embedded in the diaphragm for sliding engagement with an arced or curled end of an actuator lever. The usual procedure is to place the plate in the diaphragm mold so that a circular lip on the inside of the diaphragm surrounds the rim of the plate. The molding procedure requiring the plate to be a mold insert is tedious and expensive.

OBJECTS OF THE INVENTION

The primary object of this invention is to provide a diaphragm and antifriction plate that is extremely simple to manufacture and assemble, and in which the diaphragm is free of localized fatigue.

SUMMARY OF INVENTION

In order to accomplish the foregoing objectives, I provide a diaphragm that has an aperture in its center. A cast or fabricated low friction plastic contact member, preferably in the form of an axially thin spool, is installed about the edges of the diaphragm aperture. The spacing between the spool flanges is slightly greater than the thickness of the diaphragm so that the contact member of the spool is, to a limited degree, free to move slightly. No localized fatigue failure point exists.

The diaphragm is of uniform thickness at its operating center. No positive seal is required about the hole, because the slight pressure difference causes the edges about the diaphragm aperture to seal against the companion surface of the inside spool flange. Moreover, the pressure difference, by virtue of the very operation of the regulator itself, is to maintain virtual pressure equality so that there is no real coercive force tending to cause leakage.

BRIEF DESCRIPTION OF THE DRAWINGS

A detailed description of the invention will be made with reference to the accompanying drawings wherein like numerals designate corresponding parts in the several figures. These drawings, unless otherwise indicated, are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

Figure 1:
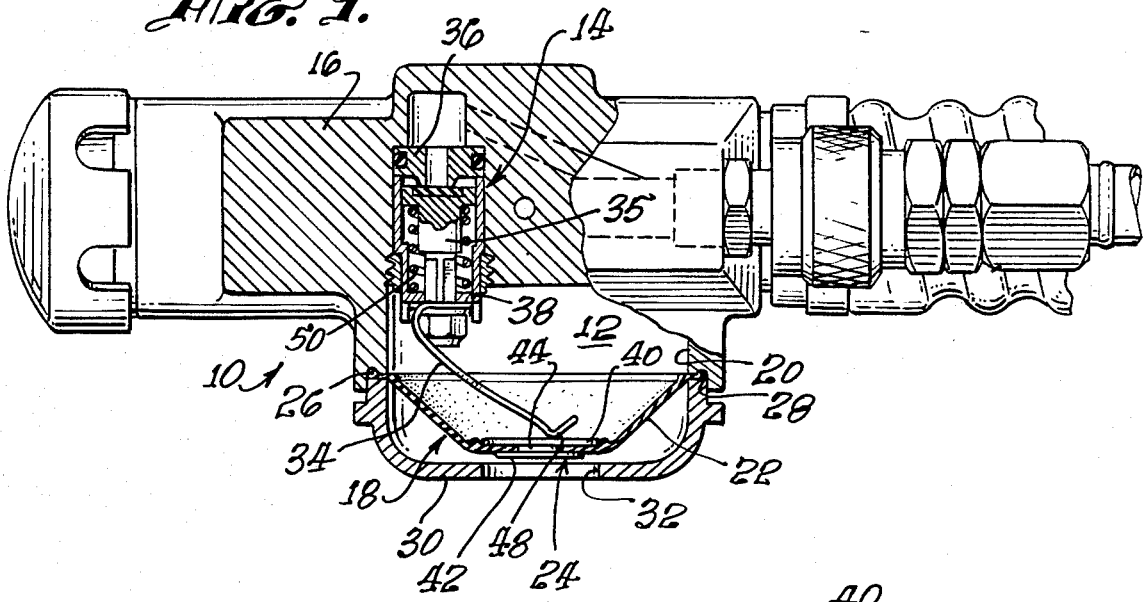
FIG. 1 is a horizontal sectional view of a typical second stage scuba regulator utilizing a diaphragm assembly incorporating the present invention.
Figure 2:
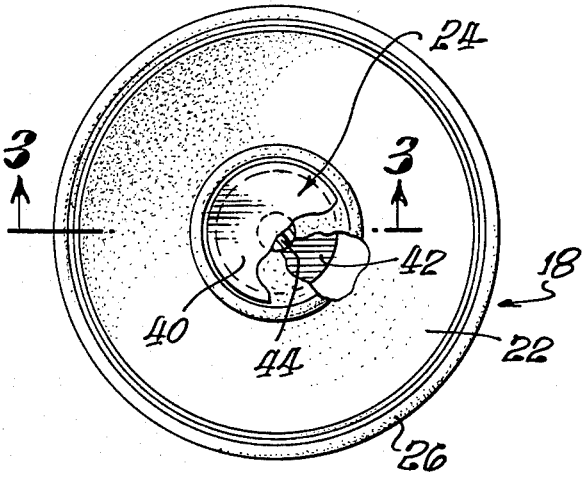
FIG. 2 is an enlarged plan view of the diaphragm assembly, part of the contact member being broken away and shown in section, and part of the diaphragm being broken away to reveal part of the contact member on the outside.

In FIG. 1 there is illustrated a typical second stage scuba regulator 10 having a breathing chamber 12 from which the diver draws air, as by a mouthpiece (not shown) located on the rear side of the regulator 10. Air is supplied to the breathing chamber 12 via a demand valve 14. The demand valve is supplied from a relatively high pressure source such as a compressed air tank and first stage regulator (not shown).

The breathing chamber is defined by the regulator body 16 and a diaphragm assembly 18 attached at a lateral opening 20 of the regulator body. The diaphragm assembly 18 includes a diaphragm 22 and a contact member 24 attached to the center of the diaphragm 22. The diaphragm is made of silicone rubber or other suitable elastomeric material. A beaded peripheral rim 26 of the diaphragm fits a shallow groove 28 surrounding the body opening 20, and is clamped in place by the aid of a cap or cover 30 as by screws (not shown). The cover 30 has at least one opening 32 to expose the outside of the diaphragm assembly to the ambient water.

The diaphragm assembly 18 cooperates with the demand valve 14 to maintain pressure in the breathing chamber 12 at a value substantially equal to that of the surrounding water. For this purpose, inward movement of the diaphragm assembly causes the demand valve 14 to open. The demand valve includes an actuator in the form of a lever arm 34 that, when moved inwardly from the full line position shown, cranks a valve closure 35 away from its seat 36 to open the demand valve. Air flows past the closure 35 and through ports (not shown) in the lower end of the demand valve case 38 to the breathing chamber 12.

Figure 4:
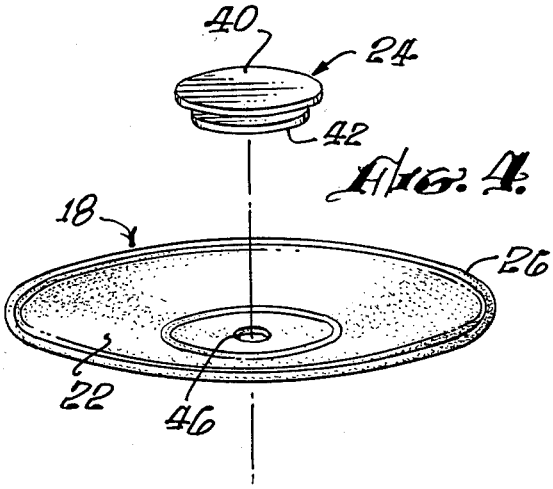
FIG. 4 is a pictorial view of the two parts comprising the diaphragm assembly positioned for assembly.
Figure 3:
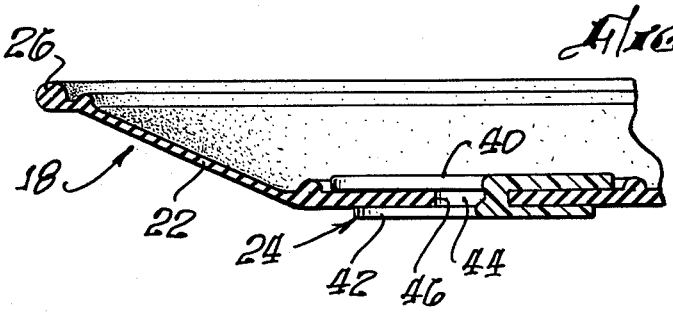
FIG. 3 is an enlarged fragmentary sectional view taken along a plane corresponding to line 3—3 of FIG. 2.

The contact member 24 provides a suitable mechanical connection between the diaphragm and the actuator lever 34. The contact member 24 is cast of low friction material such as TEFLON ®. The contact member 24 is generally in the form of an axially thin spool with end plates 40 and 42 on opposite sides connected by a circular neck 44 of reduced diameter. The neck 44 fits a central aperture 46 at a slightly thickened central region of the diaphragm 22. To install the contact member 24 (FIG. 4), the diaphragm 22 is simply stretched so that the outer end plate 42 conveniently of slightly reduced diameter, can be passed through the aperture 46. The elastic diaphragm returns to fit between the end plates with the edges of the aperture 46 close to the neck 44.

The nominal spacing between the end plates 40 and 42 may be 0.004" to 0.006" greater than the nominal thickness of the corresponding portion of the diaphragm 22. There is no adhesive between the parts. Hence, the contact member is free to creep. Localized pressure on the diaphragm is avoided.

The inside end plate 40 engages an arced or curled end 48 of the actuator lever 34. The line of contact extends generally radially of the end plate 40. Since the contact member is free to creep, the contact line changes. Scoring is avoided, and long low friction life is ensured.

The simple fit between the contact member 24 and the diaphragm 22 achieves an effective seal. The area of contact between the diaphragm and the inner surfaces of the end plates 40 and 42 is substantial. The pressure on the inside of the regulator is always just slightly less than that of the ambient and corresponding to the action of the spring 50 or other biasing mechanism of the demand valve. This pressure difference is independent of the depth of the diver in the water. A light sealing pressure is thus developed between the diaphragm and the inside surface of the inside end plate 40 which is quite adequate to maintain a seal to prevent leakage.

The diaphragm assembly provides long maintenance-free life. Complex fabrication or molding procedures for the diaphragm assembly are avoided.

PRIOR ART STATEMENT

A known diaphragm assembly for a second stage scuba regulator incorporates a linkage member (not a contact member) installed at an aperture of the diaphragm. The linkage member has a stem apertured to receive an actuator of the demand valve. See SCUBA-PRO® manual for Regulator #11-126-000 attached hereto.

Intending to claim all novel, useful and unobvious features shown or described, I make the following claims.

I claim:

1. For a second stage scuba regulator having a body defining a breathing chamber having outlet means from which the scuba diver can draw air and an opening, said regulator including a demand valve in said body provided with an actuator arm movable in said breathing chamber in a direction having a component normal to and inwardly of the central region of said opening in the regulator body to open said demand valve, the improvement comprising:

(a) a diaphragm assembly including a diaphragm and a contact member;

(b) said diaphragm closing said regulator body opening and having a circular aperture at its central portion;

(c) means clamping the edge of said diaphragm to said body about said opening;

(d) said contact member having a configuration substantially as an axially thin spool made of low friction material, said spool having a circular neck fitting said circular aperture of said diaphragm, and having a contact plate on the inside of the diaphragm providing a flat surface along which the end of said actuator arm slides for continuous contact therewith as the diaphragm moves inwardly and outwardly of the breathing chamber in accordance with changes in gas pressure in the breathing chamber relative to the fluid pressure on the outside of said diaphragm;

(e) said contact member having an end plate attached to the neck on the outside of the diaphragm to hold the contact member in assembled relationship to the diaphragm at the aperture of said diaphragm, said neck having an axial length just slightly greater than the nominal thickness of the corresponding portion of the diaphragm, the fit between the contact member and the diaphragm being the sole means for maintaining them assembled whereby said diaphragm is free to creep to avoid localized stresses on said diaphragm and whereby the line of contact of the actuator arm with said flat surface changes when said creep occurs.

* * * * *